United States Patent [19]

Antonucci

[11] 4,362,507

[45] Dec. 7, 1982

[54] SUPPORT FOR CERAMIC WARE ARTICLE DURING FIRING

[75] Inventor: Paul Antonucci, Alden, N.Y.

[73] Assignee: Buffalo China, Inc., Buffalo, N.Y.

[21] Appl. No.: 255,270

[22] Filed: Apr. 17, 1981

[51] Int. Cl.[3] ..... F27D 5/00

[52] U.S. Cl. ..... 432/259

[58] Field of Search ..... 432/258, 259; 248/481

[56] References Cited

U.S. PATENT DOCUMENTS

| | | | |
|---|---|---|---|
| 3,266,116 | 4/1966 | Rush | 25/153 |
| 3,368,781 | 2/1968 | Altoz | 248/481 |
| 3,782,981 | 1/1974 | Rostoker | 106/73.5 |
| 3,948,594 | 4/1976 | Irwin, Jr. | 432/259 |

*Primary Examiner*—John J. Camby

*Attorney, Agent, or Firm*—Schuyler, Banner, Birch, McKie & Beckett

[57] ABSTRACT

A refractory setter device for supporting glazed ceramic ware incident its firing within a kiln comprises an open spider having an upwardly facing surface above which the ware article is to be supported with such surface having a plurality of conical pockets arranged in at least three radial locations relative to the center of the spider and a spherical ball engaged within the conical pocket at such three radial locations, such that the ceramic ware article when supported on the setter device has three point contact engagement with the spherical balls.

5 Claims, 4 Drawing Figures

SUPPORT FOR CERAMIC WARE ARTICLE DURING FIRING

BACKGROUND OF THE INVENTION

This invention relates generally to kiln firing of ceramic ware. More specifically the invention is directed to support or setter devices for the ware when it is disposed within a kiln during the firing operation.

In the firing of ceramic and glass-ceramic articles having a glaze composition applied thereto, it is conventional to utilize supports therefore composed of a refractory material. Such techniques are used in the present day practice employed in the manufacture of glazed dinner ware and involves supporting the ware, after being dipped in unfused glaze, on a plural point support provided by refractory elements of different shapes, such as upright pins, tetrahedrons or spheres.

One of the problems of firing the glaze upon the outer surface of the ware is the adherence between the glaze and the support with consequent pitting of the glazed surface at those points of contact between the ware and support. Such pits extend through the glazed surface and appear as dark spots during subsequent use of the ware. Depending upon the nature of the support, portions thereof may tend to adhere to the ware and to sever from the support. These portions must be ground from the surface of the ware.

The refractory setter device for supporting glazed ceramic ware during firing within a kiln should ideally demonstrate four characteristics. Certainly it must be capable of withstanding the high temperatures required for glazing. The setter material must exhibit good resistence to thermal shock so that degradation through cracking and spalling is not encountered. This material must not react chemically with the glaze or the clay body of the article being fired. Finally, the material of which the setter is made must not be wetted by the glaze such that a glaze-to-glaze bond will create sticking between the ceramic ware article and the refractory setter device.

In the prior art, U.S. Pat. Nos. 3,266,162 to Rush; 3,782,981 to Rostoker and 3,948,594 to Irwin, Jr. are illustrative of several present day practices employed in supporting ware during firing operations. However, in using the proposals suggested in the prior art, some drawbacks or disadvantages have been encountered. As the glaze fuses during the firing operation, it wil run and fuse to the support pins or elements that are acting to support the ware, thus requiring the pins or elements in some cases to be broken away or otherwise removed from the ware after it is removed from the kiln. Often fragments of the refractory material of which the setter device is constructed are left fused into the glaze and must be ground away or dressed.

SUMMARY OF THE INVENTION

The refractory setter device of the instant invention employs an open spider that provides an upwardly facing surface above which a ceramic ware article is supported during firing within the kiln. Spherical balls giving a 3-point support for the article are engaged within conical pockets formed within the upper surface of the spider. The configuration of these conical pockets is important in that the spherical ball engaged within each conical pocket contacts with the spider at only a few points or in a limited line contact between the ball and the periphery of the base of the conical pocket.

Beneficially, under the teachings of the invention, each conical pocket has a cone base which is of a diameter sufficiently less than the diameter of the spherical ball that is to engage therewith such that the ball exterior only contacts or engages with the perimeter of the base of the conical pocket. With this limited contact between the ball and the perimeter of the base of the conical pocket, any fused glaze which may run down over the ball's surface is stopped at the line of contact. Thereafter, in cleaning off the spider for its reuse, these spherical balls may be simply broken away from a possible bond of glaze that may have formed between the ball and the perimeter of the conical pocket in which it has been carried.

Thus, a principal object of the invention is to provide an improved refractory setter device that will support a ceramic ware article during the firing operation in such a manner that the setter device may be most readily cleaned for reuse after each firing operation while still avoid excess scaring or marking of the glaze on the article being available.

A further object of the invention is to provide a refractory setter device having the capability of supporting more than one size of dinner ware with one size setter device being available.

Another object of the invention is to provide a refractory setter device utilizing a spider and spherical balls having improved limited contact engagement between these parts such that mass production of ceramic ware articles may be accomplished by repeated utilization of the device.

The above and other objects of the invention will be made more apparent from the following detailed description of a preferred embodiment given in connection with the accompanying drawings that form a part of such description.

DESCRIPTION OF A PREFERRED EMBODIMENT

Figure 1:
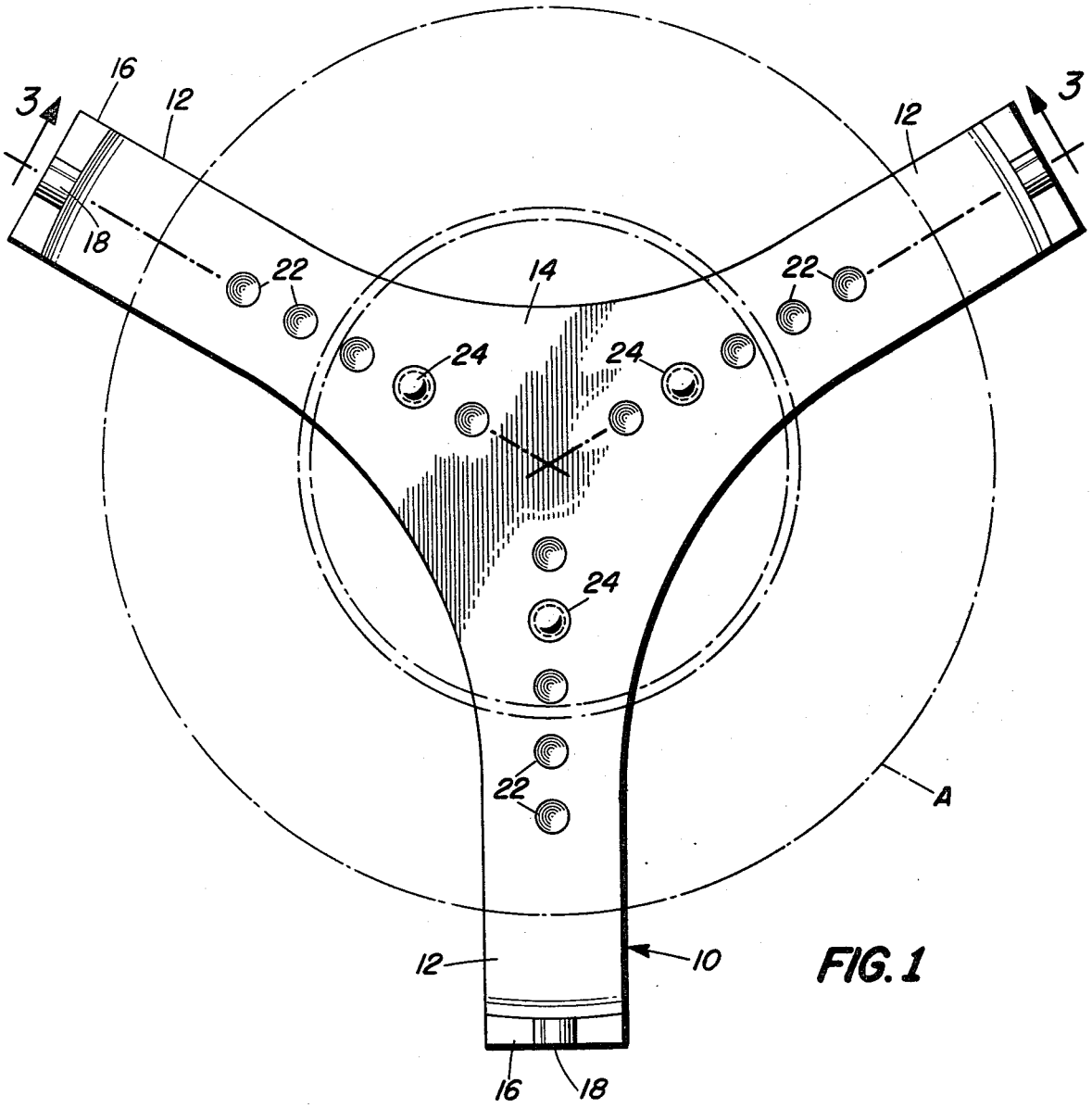
FIG. 1 is plan view of the refractory setter device invention showing a dinner ware ceramic article in phantom supported on such device.
Figure 2:
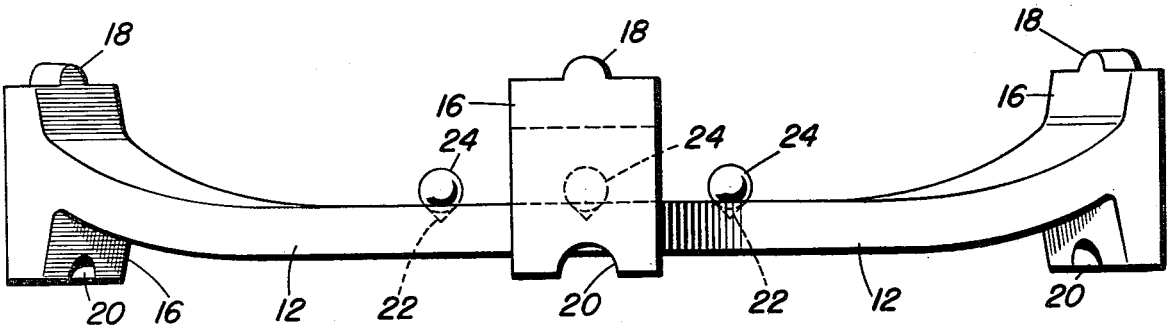
FIG. 2 is a side elevational view of the device shown in FIG. 1.
Figure 3:
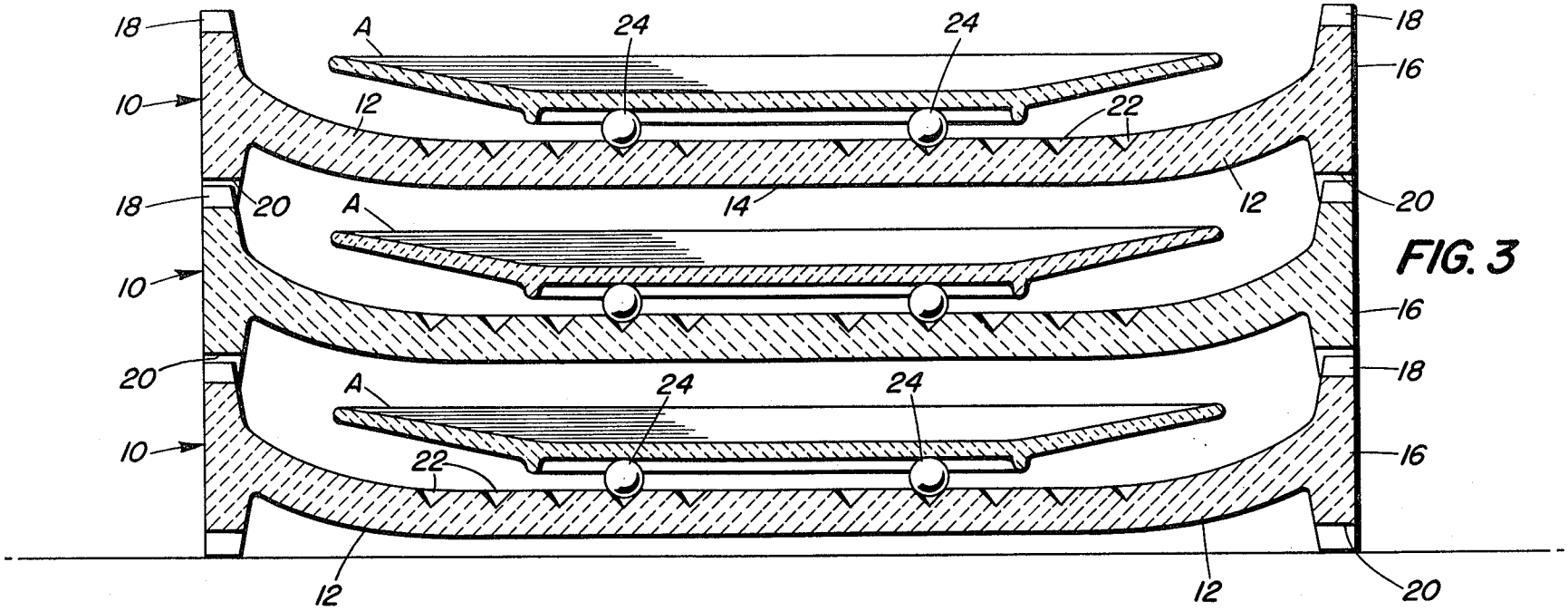
FIG. 3 is a sectional view taken on line 3—3 of FIG. 1 but showing several refractory setter devices stacked with dinner ware articles in condition for kiln firing.

FIG. 1 shows a plan view of any open spider 10. The position of a flat ware article A when supported on spider 10 is shown in phantom on FIG. 1. FIG. 3 shows several open spiders 10 stacked on top of each other with each spider having a flat ware article A supported thereon. The configuration of the spiders 10 is such that they accommodate stacking whereby spiders on top of each other are maintained sufficiently spaced such that adjacent spiders can accommodate support of a ceramic ware article therebetween.

Each open spider 10 presents an upwardly facing surface above which a ceramic ware article is to be supported. This surface is provided by arms 12 extending radially from a central portion 14 of the spider, three such arms being present on the illustrated embodiment of spider 10.

The outer end of each arm 12 is shown provided with a suitable stacking means 16. Means 16 may be provided by an upstanding leg integral with the outer end of each arm 12 to facilitate keyed together stacking of several of the open spiders 10 in the manner as illustrated on FIG. 3. Each upstanding leg 16 is shown having a projection 18 at the upper end thereof and a notch 20 at the lower end thereof. The projections 18 and notches 20 are configured such they may be readily interengaged as between adjacent spiders 10 with the projections 18 on one spider 10 nestingly engaging into the notches 20 on the lower ends of the legs 16 carried by the open spider 10 stacked thereabove.

The upwardly facing surface of spider 10 provided by arms 12 and center portion 14 has a plurality of conical pockets 22 disposed therewithin. Thus, in the upwardly facing surface provided by each leg 12, there is a series of conical pockets spaced along a radial line extending from the center of central portion 14 of open spider 10. Accordingly, with the three legs 12 as illustrated, there are three series of conical pockets with each series spaced along one of three radial lines that intersect at the center of the spider central portion 14.

Each conical pocket 22 has the base of the cone that defines the pocket disposed in the plane of the upwardly facing surface of spider 10.

Figure 4:
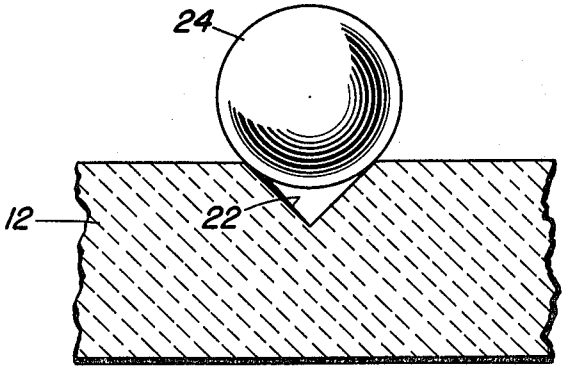
FIG. 4 is an enlarged sectional view showing a supporting spherical ball engaged with a conical pocket of the spider.

The supporting element for the ceramic ware article A is provided by a plurality of spherical support balls 24. The spherical balls 24 are engaged within the conical pockets 22 as shown in enlarged illustration FIG. 4. The open spider 10 in combination with spherical support balls 24 that are received in conical pockets 22 of the spider combine to complete the refractory setter device of the invetion.

By providing three series of pockets 22 spaced radially outwardly along the three arms 12 of the open spider 10, the location of three spherical balls 24 as engaged with conical pockets 22 can be selected as desired in accordance with the needs of each particular ceramic ware article to be supported on the refractory setter device when it is to be located in the firing kiln. It is of course to be recognized that, depending upon the character, shape and size of the ceramic ware article to be fired, three or more balls 24 may be employed by suitably locating them in the appropriate conical pockets 22 of the spider 10. By the appropriate selection of the number and location of spherical balls 24, ceramic ware articles such as oval platters and heavier plates may readily be accommodated.

By reference to the positioning of ceramic ware articles A as shown on FIGS. 1 and 3 on the drawings, it will be seen that these spherical support balls 24 are engaged within the proper conical pockets 22 so that any minimal marking of the glaze remaining after firing of article A will be disposed inside the foot on the underside of the article A. Any pin or pock mark undesirably produced incidental the firing of the glaze on the article will thus not occur outside the foot or on the foot.

Attention should be directed to the dimensional relationships between the configuration of conical pocket 22 and spherical support ball 24. As mentioned hereinabove the base of the cone forming each conical pocket 22 is disposed to lie in the plane of the upwardly facing surface on the arms 12 of spider 10. Preferably the diameter of this base is selected to be less than the diameter of the spherical support ball 24 which is to engage within the particular pocket 22. This size relationship gives the advantage of the exterior of spherical ball 24 engaging with the perimeter of the base of the cone pocket 22 as most clearly illustrated on the enlarged view of FIG. 4. By selecting such a dimensional relationship between the conical pocket 22 and the spherical support ball 24, essentially and ideally there will be a line contact between the exterior of the ball where it engages with the perimeter of the base of conical pocket 22.

Accordingly, should the kiln firing operation result in fused glaze material running down over the surface of ball 24 and onto the upwardly facing surface of spider 10, only the limited point or line contact between the cone base perimeter and ball 24 will be bridged. The glaze material will not run down into the conical pocket 22 which could have the deleterious effect of bonding the spherical support ball 24 within conical pocket 22 on spider 10. Such could make removal of spherical 24 from the spider 10 difficult, if not impossible, thereby interferring with the desired capability for reuse of the spiders in subsequent kiln firing operations.

In essence, the weight of each support ball 24 acts to press it down firmly into its conical pocket 22 such that the line contact between the exterior of the ball and the perimeter of the cone base of the pocket 22 presents an effective seal against fused glazing material entering the pocket during firing of the glaze material within a kiln.

From the above description of the invention a number of advantages may be readily recognized. The refractory setter device eliminates the presence of sharp pin marks such as are characteristically produced incident the use of usual triangular shaped pins set into a slot in the ware holder. The ceramic ware article is better supported for the firing action within the kiln. In mass production operations the placement of the spherical support balls 24, and handling of the setter spiders 10 with only three handling points disposed at a 120° to each other is easier to automate. The conically shaped pocket is preferable and advantageous over the half round hole or groove that has previously been used since the spherical ball does not fit into it snuggly but rather has fewer points of contact so that the glaze does not fuse the ball into the hole as is the case when using the half round hole or groove. Also if the ball does not fit snuggly into the half round hole as has been previously used, it will roll, causing the ceramic ware article to move prior to firing and thus shift from its desired location.

A preferred embodiment of this invention has been illustrated and described hereinabove. It will be understood however that various modifications may be made by those skilled in the art without departing from the scope of the invention contemplated herein, as such the invention is defined solely by the appended claims.

I claim:

1. A refractory setter device for supporting glazed ceramic ware within a firing kiln comprising:

an open spider providing an upwardly facing surface above which a ceramic ware article is to be supported within the firing kiln;

a plurality of conical pockets opening outwardly of and disposed within said upwardly facing surface, at least one said conical pocket being disposed in each of three radial locations relative to the center of said spider; and a spherical ball engaged within one said conical pocket at each of said three radial locations whereby a ceramic ware article when supported on said setter device has three point contact engagement with said spherical balls, each said ball having the exterior thereof in limited line contact with the conical pocket within which the ball is engaged.

2. A refractory setter device as recited in claim 1 wherein said spider has at least three arms extending radially from a central portion of said spider, and each of said arms has means adjacent the radially outer end thereof to accommodate stacking a plurality of said spiders on top of each other while maintaining adjacent spiders spaced sufficiently to support a ceramic ware article therebetween.

3. A refractory setter device as recited in either of claims 1 or 2 wherein each said conical pocket has the cone base thereof disposed in the plane of said upwardly facing surface, and said base has a diameter less than the diameter of said spherical ball that is engaged therewith.

4. A refractory setter device as recited in claim 3 wherein said cone base is of a diameter sufficiently less than the diameter of said spherical ball such that the ball exterior engages with the perimeter of the base of the conical pocket within which it is received.

5. A refractory setter device as recited in either of claims 1 or 2 wherein said upwardly facing surface has a series of said conical pockets spaced along each of at least three radial lines that intersect at the center of said spider.

* * * * *